US006584968B1

(12) United States Patent
Morton

(10) Patent No.: US 6,584,968 B1
(45) Date of Patent: Jul. 1, 2003

(54) KITCHEN VENTILATOR AND ASSOCIATED CONTROL METHOD

(75) Inventor: Philip O'Farrell Morton, Portland, OR (US)

(73) Assignee: ITW Food Equipment Group LLC, Troy, OH (US)

( * ) Notice: Subject to any disclaimer, the term of this patent is extended or adjusted under 35 U.S.C. 154(b) by 268 days.

(21) Appl. No.: 09/668,927

(22) Filed: Sep. 25, 2000

(51) Int. Cl.[7] ..... F24C 15/20

(52) U.S. Cl. ..... 126/299 E; 126/299 R; 126/299 D; 55/DIG. 36

(58) Field of Search ..... 126/21 R, 299 R, 126/299 C, 299 D, 299 E, 299 F, 300, 301; 55/DIG. 36; 454/369, 347

(56) References Cited

U.S. PATENT DOCUMENTS

| | | | | |
|---|---|---|---|---|
| 1,994,365 A | | 3/1935 | Mathews | 196/116 |
| 2,813,477 A | * | 11/1957 | Gaylord | |
| 2,961,941 A | | 11/1960 | Graswich et al. | |
| 3,055,285 A | * | 9/1962 | Gaylord | |
| 3,065,687 A | * | 11/1962 | Graswich et al. | |
| 3,207,058 A | * | 9/1965 | Gaylord | |
| 3,785,124 A | | 1/1974 | Gaylord | |
| 4,029,002 A | | 6/1977 | Vandas | 98/115 K |
| 4,066,064 A | * | 1/1978 | Vandas | |
| 4,072,143 A | * | 2/1978 | Gaylord | |
| 4,266,529 A | | 5/1981 | Gaylord | |
| 4,281,635 A | | 8/1981 | Gaylord | 126/299 |
| 4,581,987 A | | 4/1986 | Ulicny | |
| 4,607,614 A | | 8/1986 | Higashino et al. | |
| 4,784,114 A | | 11/1988 | Muckler et al. | 126/299 E |
| 6,349,716 B1 | * | 2/2002 | Morton | |

FOREIGN PATENT DOCUMENTS

| | | | | |
|---|---|---|---|---|
| JP | 60 256739 | | 12/1985 | |
| JP | 61 22143 | | 1/1986 | |
| JP | 61-66032 | * | 4/1986 | 126/299 E |
| JP | 61 128049 | | 6/1986 | |
| JP | 61-180845 | * | 8/1986 | 126/299 E |

OTHER PUBLICATIONS

K–TECH, "Finalist Wash Ventilator With Make–Up Section", Muckler Industries, Inc., 1/94.

Greenheck, "Installation, Operation, and Maintenance Manual, Automatic Fire Damper", 6/99, pp. 1–12, 37–43.

Greenheck Kitchen Ventilation Systems, "Automatic Fire Damper for Greenheck Kitchen Hoods", 1/99.

* cited by examiner

*Primary Examiner*—Carl D Price
(74) *Attorney, Agent, or Firm*—Thompson Hine LLP

(57) ABSTRACT

A ventilator includes a hood structure having an air inlet slot and a multi-position damper baffle within the hood structure. The damper baffle is movably positioned adjacent the air inlet slot for movement between (i) an exhaust cycle position in which the damper baffle allows gases to flow through the hood structure, (ii) a wash cycle position in which the damper baffle closes off the air inlet slot; and (iii) a fire cycle position in which the damper baffle divides the hood structure into an upper section and a lower section. A manifold and associated water control valve may also be provided, along with a motor for controlling damper baffle positioning, an exhaust fan for air flow, and with a controller being provided for automated operation. In an internal fire mode of the controller the damper baffle is moved to the fire cycle position, the exhaust fan is turned off and the water control valve is opened. In a wash cycle mode of the controller the damper baffle is moved to the wash cycle position, the exhaust fan is turned off and the water control valve is opened. In an external fire mode of the controller the damper baffle is moved to the exhaust cycle position, the exhaust fan is turned on and the water control valve is opened.

13 Claims, 5 Drawing Sheets

KITCHEN VENTILATOR AND ASSOCIATED CONTROL METHOD

FIELD OF THE INVENTION

The present invention relates generally to ventilator hoods used in commercial kitchens, and more particularly, to a multi-configuration ventilator hood which is selectively configurable for exhaust, wash and fire modes, and a related control system and method.

BACKGROUND OF THE INVENTION

Kitchen ventilator hoods have long been provided for the purpose of exhausting steam, smoke and particulates such as grease which are produced in the commercial kitchen environment. U.S. Pat. No. 4,281,635 describes a kitchen ventilator with a movable damper baffle which can be pivoted between open and closed positions. However, improvements are continually sought in the areas of ventilator cleanability and fire protection.

SUMMARY OF THE INVENTION

In one aspect of the present invention, a ventilator includes an air inlet slot and a multi-position damper baffle movably positioned adjacent the air inlet slot for movement between an exhaust cycle position, a wash cycle position and a fire cycle position. In the exhaust cycle position the damper baffle angles inward and downward from the air inlet slot such that exhaust air flows into the air inlet slot, downward and around a free end of the damper baffle, and upward to an exhaust outlet. In the wash cycle position the free end of the damper baffle is rotated in a first direction toward the air inlet slot for preventing air from entering the through the slot. In the fire cycle position the free end of the damper baffle is rotated in a second direction away from the air inlet slot and adjacent an interior portion of the ventilator to divide the ventilator into an upper section and a lower section, wherein the damper baffle prevents air flow into the upper section and also forms a barrier permitting fluid to be retained within the upper section.

A further aspect of the present invention provides a ventilator which includes a hood structure having an air inlet slot and a multi-position damper baffle within the hood structure. The damper baffle is movably positioned adjacent the air inlet slot for movement between (i) an exhaust cycle position in which the damper baffle allows gases to flow through the hood structure, (ii) a wash cycle position in which the damper baffle closes off the air inlet slot; and (iii) a fire cycle position in which the damper baffle divides the hood structure into an upper section and a lower section. A manifold and associated water flow control element may also be provided, along with a motor for controlling damper baffle positioning, an exhaust fan for air flow, and with a controller being provided for automated operation. In an internal fire mode of the controller the damper baffle is moved to the fire cycle position, the exhaust fan is turned off and delivery of water by the flow control element is effected. In a wash cycle mode of the controller the damper baffle is moved to the wash cycle position, the exhaust fan is turned off and delivery of water by the flow control element is effected. In an external fire mode of the controller the damper baffle is moved to the exhaust cycle position, the exhaust fan is turned on and delivery of water by the flow control element is effected.

DETAILED DESCRIPTION OF THE EMBODIMENTS

Figure 1:
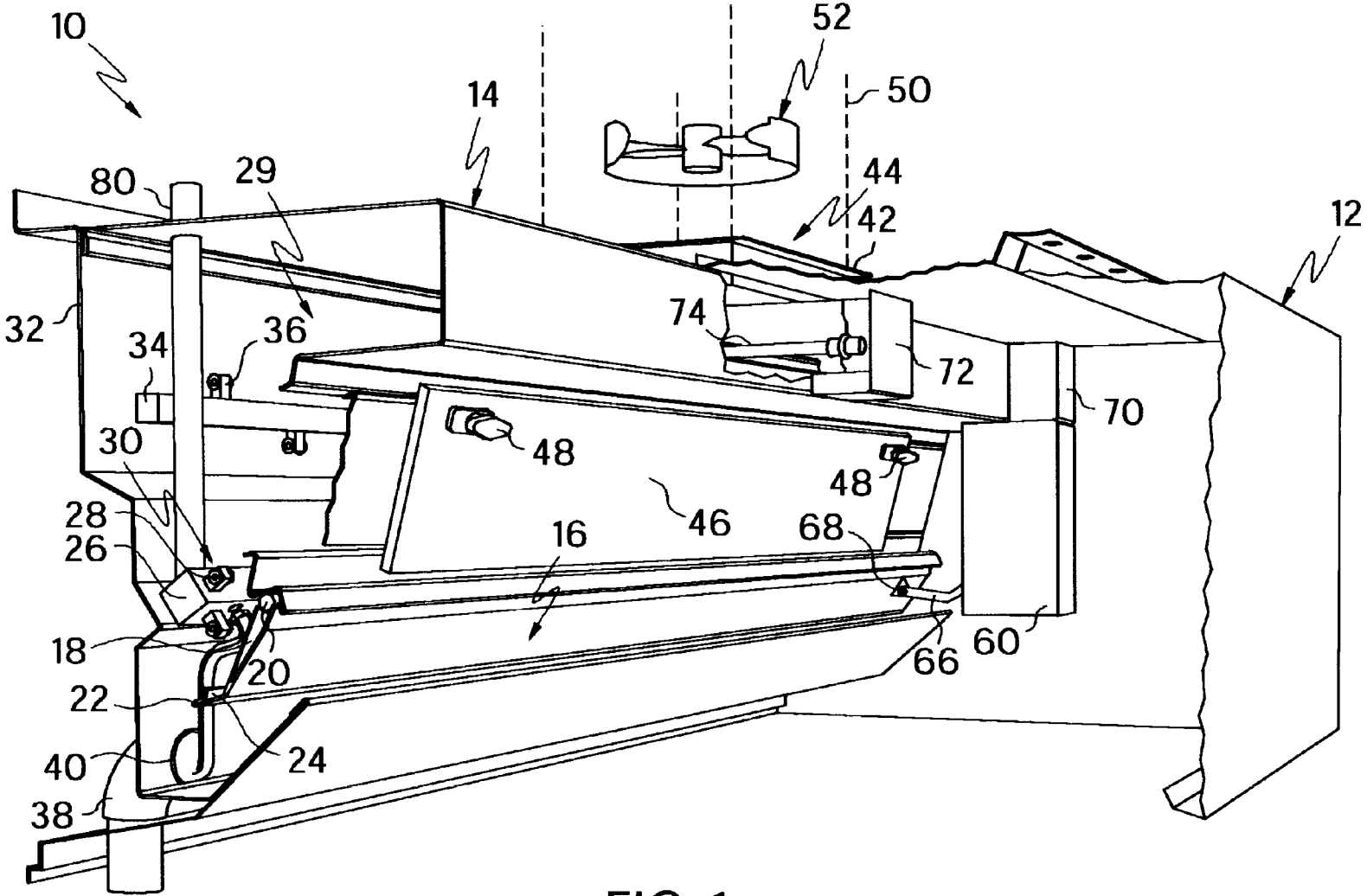
FIG. 1 is a partially broken away perspective view of a ventilator according to one embodiment of the invention.

Referring to drawing FIG. 1, a ventilator 10 is shown in perspective view with part of the front and left sides cut away. The ventilator 10 is typically positioned above a large commercial cooking area (not shown) which may include one or more cooking stations such as a griddle, range, fryer, and/or broiler, and is typically mounted to a wall or hung from the ceiling over the cooking area.

The ventilator 10 includes an outer housing 12 with an open bottom, the housing 12 encompassing an interior hood structure 14. The inner hood structure 14 includes an air inlet slot 16 with a moveable damper baffle 18 positioned adjacent to the inlet slot 16 and pivoted at end 20 such that the free end 22 of the damper baffle 18 can be rotated about the pivot point. The free end 22 of the damper baffle 16 also includes a grease catch 24 on the interior side thereof. A lower wash manifold 26 is provided towards the rear of the ventilator hood structure 14 and includes a plurality of spray nozzles 28 for introducing hot water and/or cleaning fluid to the interior 29 of the structure 14. Than manifold 26 also forms a grease catch 30 with the rear panel 32 of the hood structure 14. An upper wash manifold 34 with nozzles 36 is also provided. Near the bottom of the hood structure 14 a drain line or pipe 38 is provided and is connected through an opening 40 in the rear side of rear panel 32. The drain permits grease and water/cleaning fluid to be removed from the interior 29 of the hood structure 14.

An exhaust duct collar 42 defines an exhaust outlet 44 in the upper surface of the hood structure for permitting gases, grease, etc. to be drawn through the ventilator and exhausted at a sight external to the kitchen. An inspection door 46 with handles 48 is provided at the front of the hood structure to permit easy access to the interior 29 of the hood structure 14 as necessary for cleaning, maintenance, etc. Duct work 50 is typically attached to the exhaust duct collar 42 as necessary to remove exhaust gases from the building and an exhaust fan 52 is typically placed somewhere along the exhaust duct 50 to assist in exhausting the gases.

Figure 2:
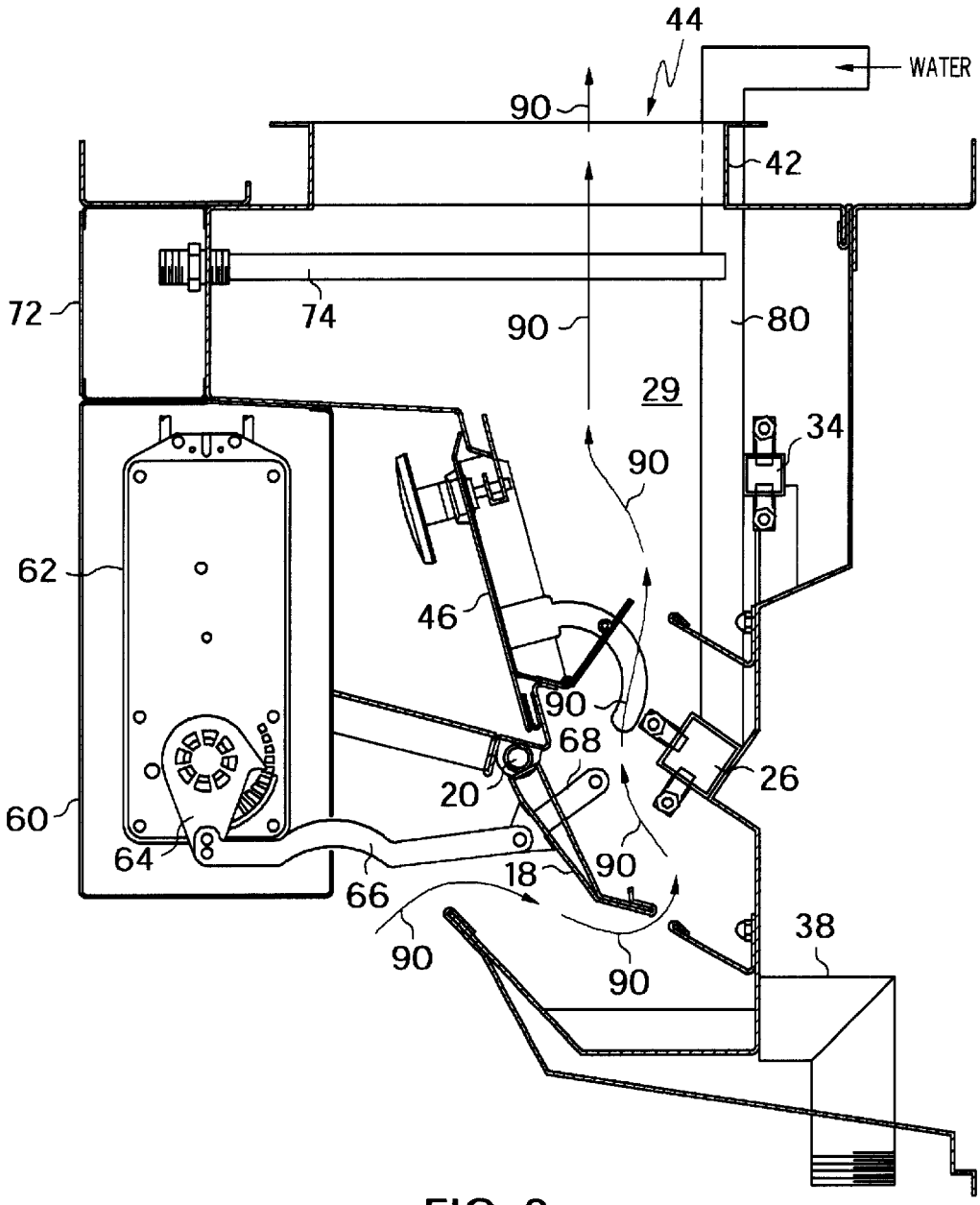
FIG. 2 is a right side elevation view of the interior of the ventilator of FIG. 1 with baffle in an exhaust cycle position.

Toward the right side of hood structure 14 a damper baffle motor box 60 is provided for housing the damper baffle motor 62 shown in the right side elevation of FIG. 2. Rotation of motor 62 correspondingly rotates a sprocket linkage 64 having an elongated rod-type linkage 66 associated therewith. The rod-type linkage 66 is connected to the damper baffle 18 via a bracket 68. Thus, by controlling rotation of motor 62, movement of the damper baffle 18 about its pivoted end 20 can be obtained as desired. The motor assembly utilized may be a motor drive—spring return damper motor which utilizes a spring to set the sprocket linkage 64 to a standard position when the motor is not energized. In this case it is preferred that the standard position be chosen to locate the damper baffle 18 in the fire cycle position (shown in FIG. 5). An electrical junction box 70 is also provided.

Positioned along the upper front portion of the hood structure 14 is a thermostat junction box 72 which is shown partially broken away in FIG. 1. A thermostat 74 extends into the interior 29 at this position for producing temperature indicative signals.

Figure 3:
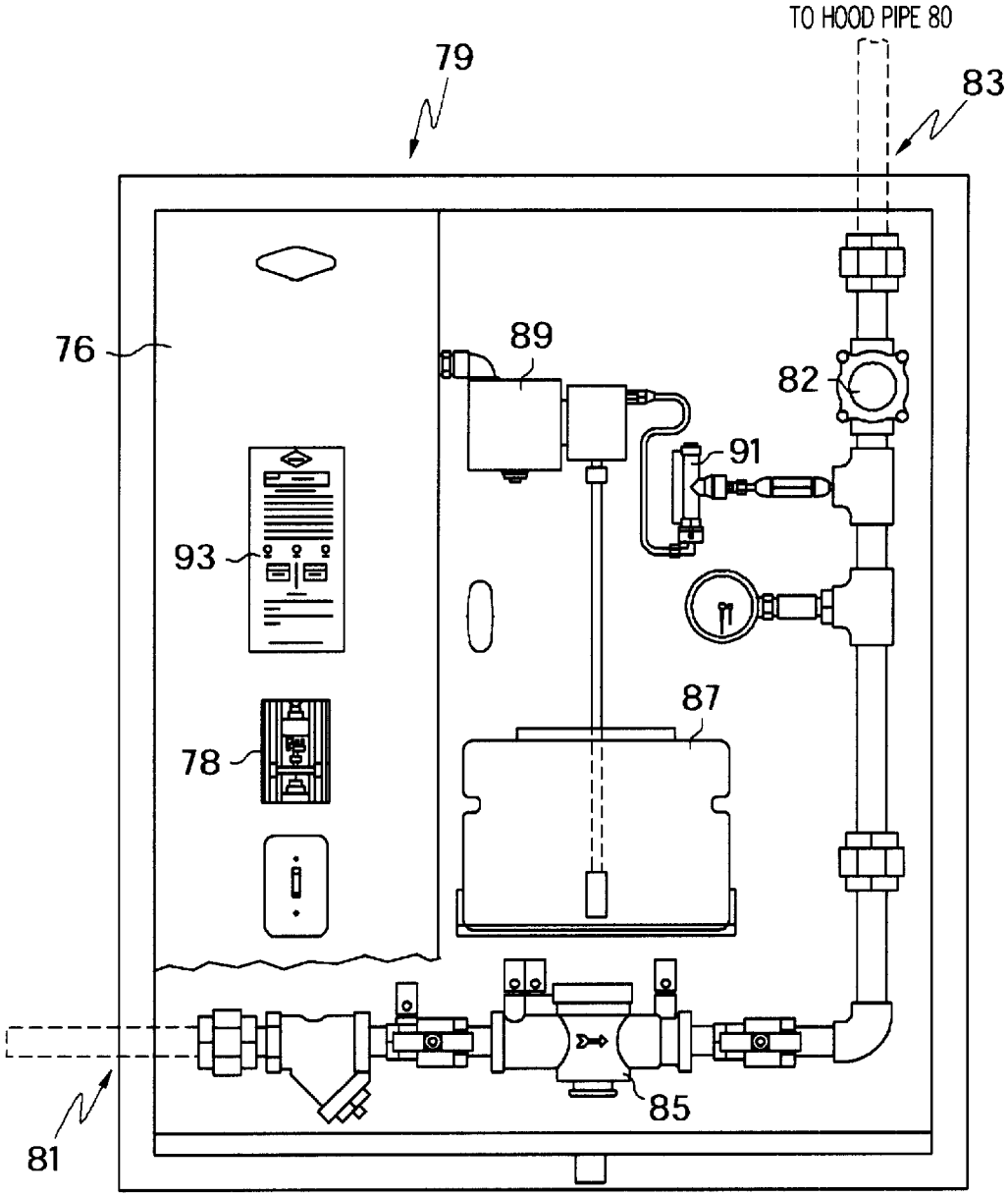
FIG. 3 is a front elevational view of a control cabinet.

The fan 52, damper baffle motor 62 and thermostat 74 are each operatively associated with a ventilator controller for providing controlled operation of the same. The controller 76 may be contained in a separate control cabinet 79 as shown in FIG. 3, with appropriate wiring extending from the thermostat 74, fan 52 and motor 62 to the control cabinet 79. When installed, the ventilator system may also include a manual fire indication switch 78 which is connected to provide an external fire indication signal to the controller 76. The switch 78 may be a break glass fire switch and could be located on the control cabinet 79 as shown or could be located near an exit of the kitchen.

Referring again to FIG. 1, a hot water inlet pipe 80 extends to both manifolds 26 and 34 for providing hot water thereto. At least one controllable valve, such as a solenoid valve, is provided for controlling the flow of hot water. In this regard, reference is made to the control cabinet of FIG. 3 which includes such a valve 82 positioned between a hot water inlet 81 and a hot water outlet 83. A backflow preventer 85 may also be provided in the line. The valve 82 may be operatively connected to the controller 76 to permit control of the valve. It is recognized that the location of the controllable valve could vary. Other flow control elements could also be provided for controlling delivery of water to the manifolds. For example, a pump could be turned off and on by the controller. It is also recognized that a cold water supply line could likewise be provided. The control cabinet 79 of FIG. 3 includes a detergent tank 87 and associated detergent pump 89 and flow switch 91 for controlling the introduction of detergent into the ventilator in combination with the water during a wash cycle.

The ventilator of the present invention provides advantageous baffle positioning and baffle, fan and manifold control as described below in more detail.

Figure 4:
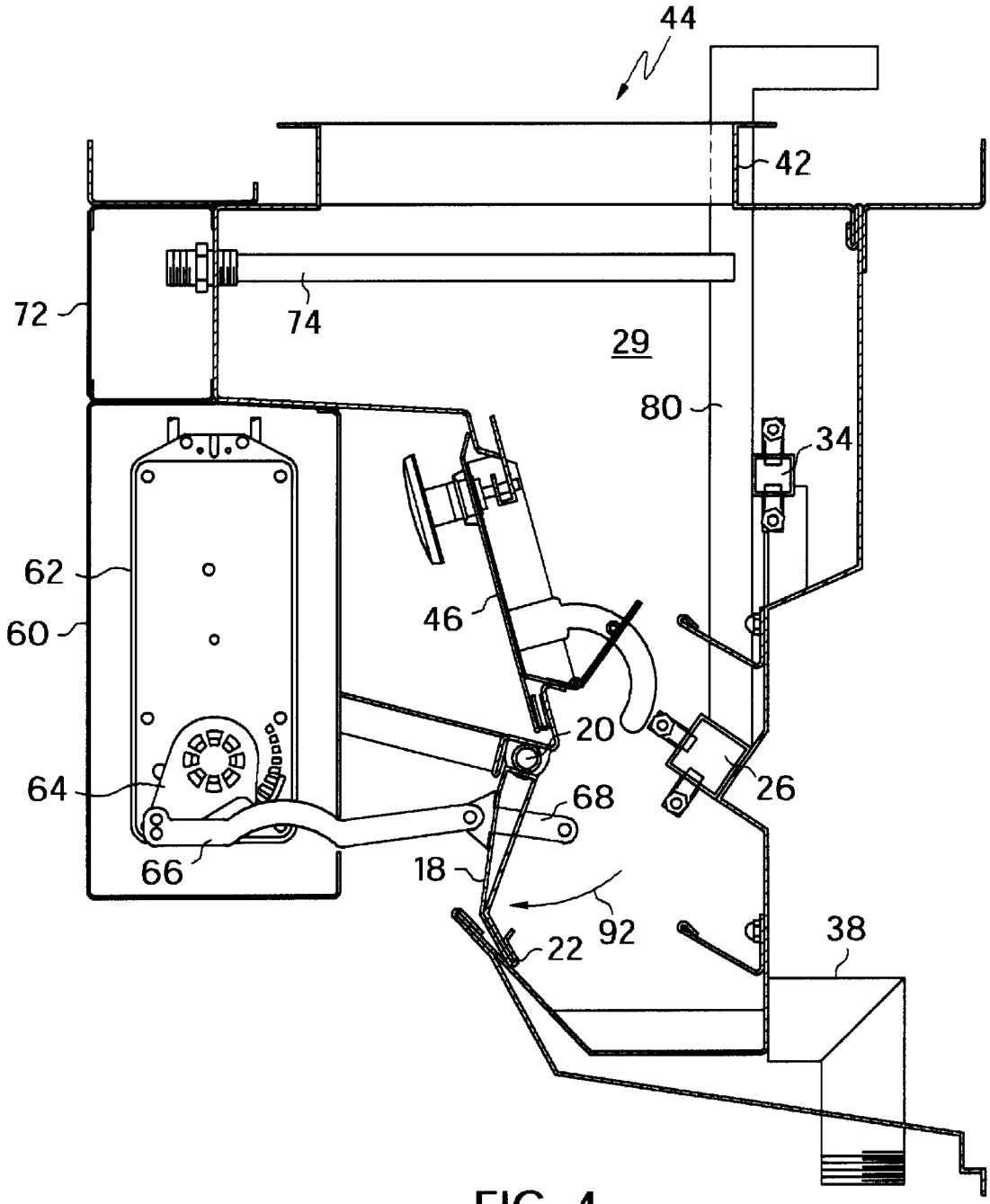
FIG. 4 is a right side elevation view of the interior of the ventilator of FIG. 1 with baffle in a wash cycle position.
Figure 5:
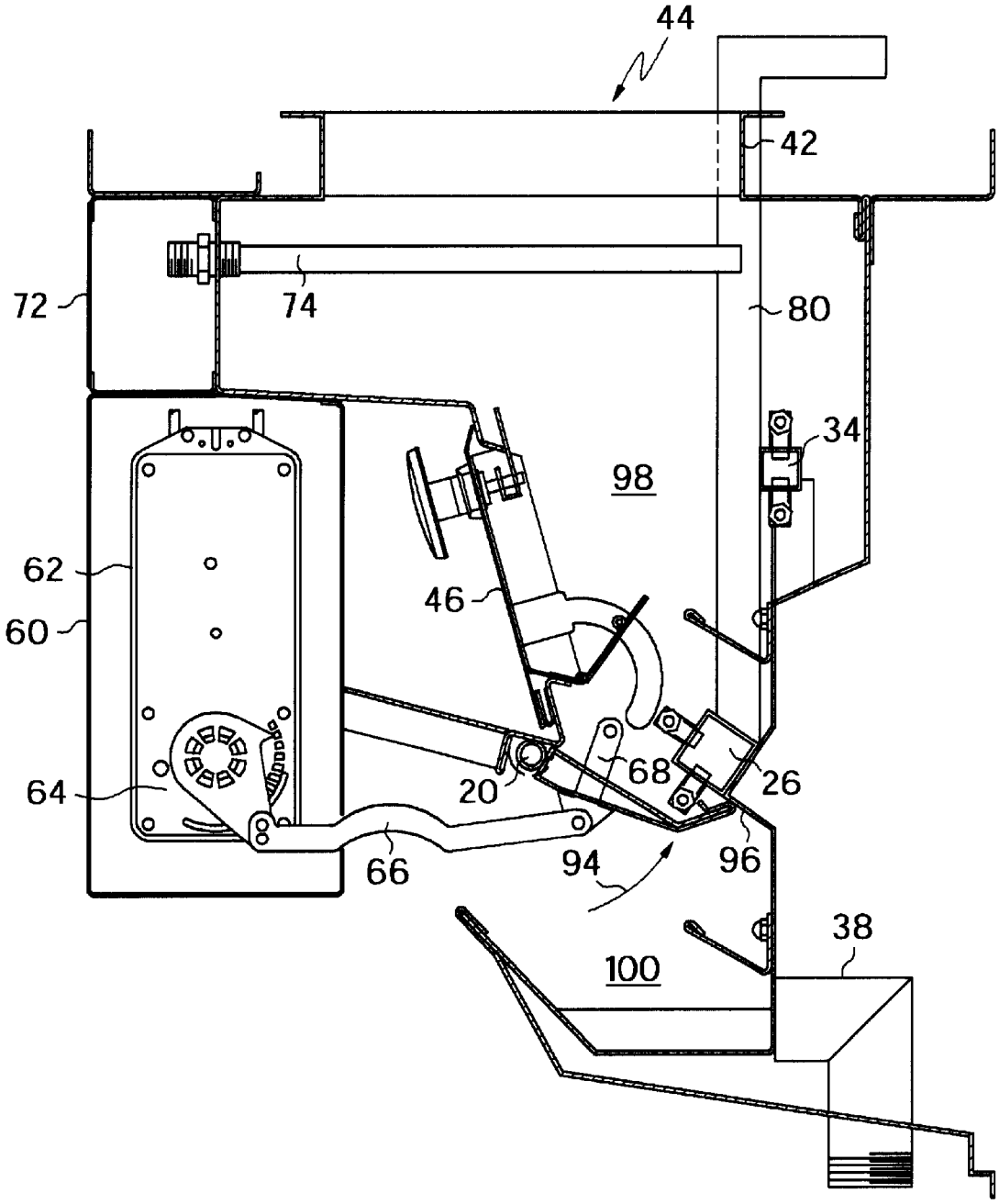
FIG. 5 is a right side elevation view of the interior of the ventilator of FIG. 1 with baffle in a fire cycle position.

The damper baffle 18 is controllably positionable as desired for particular ventilator modes. Referring to FIG. 2, the damper baffle 18 is shown in an exhaust cycle position in which the damper baffle 18 angles inward and downward from the air inlet slot 14 such that exhaust air flows into the air inlet slot 16, downward and around the free end 22 of the damper baffle, and upward to an exhaust outlet 44 as shown by arrows 90. FIG. 4 illustrates a wash cycle position of the damper baffle in which the free end 22 of the damper baffle is rotated in a first direction 92 toward the air inlet slot 16 for preventing air from entering through the slot 16, and for preventing fluid introduced to interior 29 from escaping through the slot 16 during a wash cycle. FIG. 5 illustrates a fire cycle position of the damper baffle 18 in which the free end 22 of the damper baffle 18 is rotated in a second direction 94 away from the air inlet slot 16 and adjacent an interior portion 96 of the ventilator to divide the interior of the ventilator into an upper section 98 and a lower section 100. In this fire cycle position the damper baffle 18 prevents air flow into the upper section 98 and also forms a barrier permitting fluid to be retained within the upper section 100. It is, however, recognized that the barrier need not be perfectly sealed.

The controller 76 may be of any suitable configuration desired, including an electric controller formed by relays and contacts, as well as an electronic controller or processor based controller. The controller 76 is preferably operable in multiple modes including an exhaust cycle mode. In the exhaust cycle mode the controller 76 effects rotation of the motor 62 so as to position the damper baffle 18 in the exhaust cycle position (FIG. 2), and outputs a fan on signal to turn the exhaust fan 52 on for drawing gases through the ventilator 10. The exhaust cycle mode may be triggered by depression of a fan on button or switch 93 associated with the controller 76 such as shown in FIG. 3.

In a wash cycle mode the controller 76 effects rotation of the motor 62 so as to position the damper baffle 18 in the wash cycle position (FIG. 4), outputs a fan off signal to turn off the exhaust fan 52, and opens the water valve 82 to introduce water into the interior 29 of the ventilator for cleaning purposes. Cleaning fluid may also be introduced into the interior 29 of the ventilator at the same time. The wash cycle mode may be triggered by depression of a start wash button or switch associated with the controller 76. The wash cycle may be preset to run for a predetermined time period, after which the water valve 82 is automatically closed. Multiple wash cycle time periods may be provided for selection based upon the degree of cleaning needed. Upon completion of the wash cycle, the damper baffle 18 preferably remains in the wash cycle position to prevent conditioned air from going up the exhaust system, until repositioning is called for upon entry into a different mode of operation, typically the exhaust mode.

In an internal fire mode the controller 76 effects rotation of the motor 62 so as to position the damper baffle 18 in the fire cycle position (FIG. 4), outputs a fan off signal to turn off the exhaust fan 52 and stop the combustion-supporting draft, and opens the water valve 82 to introduce water into upper section 98. The water smothers any fire located in the upper section 98 of the ventilator interior 29. The internal fire mode is preferably triggered based upon a fire indication signal output by the thermostat 74. In particular, when the temperature of the air stream passing by the thermostat reaches a threshold high temperature, such as 250° F., the temperature signal output by the thermostat 74 to the controller 76 causes the controller to enter the internal fire cycle mode. Other threshold temperatures could be used. The controller permits water to be introduced until the thermostat cools to below the threshold temperature, and after passage of a predetermined time the controller 76 then causes the water valve 82 to close. Upon completion of the fire extinguishing operation, the damper baffle 18 preferably remains in the fire cycle position until a different mode of operation is entered.

In an external fire mode the controller 76 effects rotation of the motor 62 so as to position the damper baffle 18 in the exhaust cycle position (FIG. 2), outputs a fan on signal to turn on the exhaust fan 52, and opens the water valve 82 to introduce water through the manifold 26, 34. The water smothers and/or prevents any fire within the interior 29 of the ventilator. The external fire mode is preferably triggered by a fire indication signal produced by the fire switch 78. During the external fire mode, if the thermostat 74 temperature reaches the threshold temperature, the controller 76 is placed into the internal fire mode described above.

In most kitchen ventilator systems, a supply fan (not shown) is also provided to introduce air into the kitchen as air is exhausted through the kitchen ventilator(s). In the present system control of the supply fan may also be provided by the ventilator controller 76 during the various modes of ventilator operation. In particular, in the exhaust cycle mode the supply fan would be turned on to introduce air into the kitchen as air is exhausted through the ventilator. In the internal fire cycle mode the supply fan would preferably also be shut off when the exhaust fan is turned off, and in the external fire cycle mode the supply fan would preferably be turned off, even though the exhaust fan is turned on.

Although the invention has been described and illustrated in detail it is to be clearly understood that the same is intended by way of illustration and example only and is not intended to be taken by way of limitation. Accordingly, the spirit and scope of the invention are to be limited only by the terms of the appended claims.

What is claimed is:

1. A kitchen ventilator, comprising:

a hood structure having upper, lower, front and back sides at least partially defining an interior of the ventilator, and an air inlet slot; and a multi-position damper baffle movably positioned adjacent the air inlet slot for movement between:

(i) an exhaust cycle position in which the damper baffle angles inward and downward from the air inlet slot such that exhaust air flows into the air inlet slot, downward and around a free end of the damper baffle, and upward to an exhaust outlet;

(ii) a wash cycle position in which the free end of the damper baffle is rotated in a first direction toward the air inlet slot for preventing air from entering through the slot and for preventing fluid from escaping through the slot; and (iii) a fire cycle position in which the free end of the damper baffle is rotated in a second direction away from the air inlet slot and adjacent an interior portion of the ventilator to divide the ventilator into an upper section and a lower section, wherein the damper baffle prevents air flow into the upper section and also forms a barrier permitting liquid to be retained within the upper section.

2. The kitchen ventilator of claim 1, further comprising:

a motor operatively connected for controlling movement of the damper baffle;

at least one manifold positioned within the ventilator, at least one water valve for controlling delivery or water to the manifold, the manifold having at least one outlet for introducing water to the interior of the ventilator when the water valve is opened;

a controller connected to each of the motor and the water valve, the controller including an exhaust fan control output;

wherein the controller is operable in at least three modes including:

(i) an exhaust cycle mode in which the controller positions the damper baffle in the exhaust cycle position and outputs an exhaust fan on signal;

(ii) a wash cycle mode in which the controller positions the damper baffle in the wash cycle position, outputs an exhaust fan off signal, and opens the water valve; and (iii) an internal fire mode in which the controller positions the damper baffle in the fire cycle position, outputs an exhaust fan off signal, and opens the water valve.

3. The kitchen ventilator of claim 2, further comprising:

a temperature sensor positioned within the upper section and connected to the controller for providing a fire indication signal thereto;

wherein, in response to receipt of a fire indication signal from the temperature sensor, the controller is placed in the internal fire mode.

4. The kitchen ventilator of claim 3, wherein, in the fire mode and upon no longer receiving a fire indication signal from the temperature sensor, the controller is operable to close the water valve after passage of a predetermined time period.

5. The kitchen ventilator of claim 2, wherein the controller is further operable in an external fire mode in which the controller positions the damper baffle in the exhaust cycle position, outputs an exhaust fan on signal, and opens the water valve.

6. The kitchen ventilator of claim 5, further comprising a manually triggerable fire indication switch connected to the controller for providing a fire indication signal thereto, wherein, in response to receipt of a fire indication signal from the indication switch, the controller is placed in the external fire mode.

7. The kitchen ventilator of claim 1, further comprising an inspection door positioned above the air inlet slot.

8. A kitchen ventilator, comprising:

a hood structure at least partially defining an interior of the ventilator, and including an air inlet slot; and a multi-position damper baffle within the hood structure and movably positioned adjacent the air inlet slot for movement between:

(i) an exhaust cycle position in which the damper baffle allows air to flow through the hood structure;

(ii) a wash cycle position in which the damper baffle closes off the air inlet slot; and (iii) a fire cycle position in which the damper baffle divides the hood structure into an upper section and a lower section;

a damper control operatively connected to move the damper baffle, the damper control operable in each of an exhaust cycle mode, a wash cycle mode and a fire cycle mode, when in the exhaust cycle mode the damper control moves the damper baffle to the wash cycle position, when in the wash cycle mode the damper control moves the damper baffle to wash cycle position, when in the fire cycle mode the damper control moves the damper baffle to the fire cycle position.

9. The kitchen ventilator of claim 8 wherein the damper control comprises a motor operatively connected to move the damper baffle and a controller connected to control operation of the motor.

10. The kitchen ventilator of claim 8, further comprising a wash manifold within the hood structure, a flow control element for controlling delivery of water to the manifold, wherein the damper control is also connected to the flow control element for control thereof, when in the wash cycle mode and the fire cycle mode the damper control effects water delivery by the flow control element.

11. The kitchen ventilator of claim 8, further comprising a temperature sensor within the hood structure and connected to the damper control for providing a fire indication signal thereto, in response to receipt of a fire indication signal from the temperature sensor the damper control is placed in the fire cycle mode.

12. A kitchen ventilator, comprising:

a hood structure at least partially defining an interior of the ventilator, and including an air inlet slot; and a multi-position damper baffle within the hood structure and movably positioned adjacent the air inlet slot for movement between:

(i) an exhaust cycle position in which the damper baffle allows air to flow through the hood structure;

(ii) a wash cycle position in which the damper baffle closes off the air inlet slot; and (iii) a fire cycle position in which the damper baffle divides the hood structure into an upper section and a lower section;

a motor operatively connected for controlling movement of the damper baffle;

at least one manifold positioned within the hood structure, at least one flow control element for controlling delivery of water to the manifold, the manifold having at least one outlet for introducing water to the interior of the ventilator when water is delivered by the flow control element;

at least one exhaust fan for drawing air into the air inlet;

a controller connected to each of the motor, the flow control element and the exhaust fan for control thereof; and wherein the controller is operable in a wash cycle mode in which the controller positions the damper baffle in the wash cycle position, turns off the exhaust fan, and effects water delivery by the flow control element.

13. The kitchen ventilator of claim 12 wherein the controller is further operable in an internal fire mode in which the controller positions the damper baffle in the fire cycle position, turns off the exhaust fan, and effects water delivery by the flow control element; and wherein the controller is further operable in an external fire mode in which the controller positions the damper baffle in the exhaust cycle position, turns on the exhaust fan, and effects water delivery by the flow control element.

* * * * *

UNITED STATES PATENT AND TRADEMARK OFFICE

CERTIFICATE OF CORRECTION

PATENT NO. : 6,584,968 B1
DATED : July 1, 2003
INVENTOR(S) : Philip O'Farrell Morton It is certified that error appears in the above-identified patent and that said Letters Patent is hereby corrected as shown below:

Column 6,
Line 31, change "damper baffle to the wash" to -- damper baffle to the exhaust --

Signed and Sealed this

Fourth Day of November, 2003

JAMES E. ROGAN
*Director of the United States Patent and Trademark Office*